US006750833B2

(12) United States Patent
Kasai

(10) Patent No.: US 6,750,833 B2
(45) Date of Patent: Jun. 15, 2004

(54) SYSTEM AND METHODS FOR PROVIDING A DRIVING CIRCUIT FOR ACTIVE MATRIX TYPE DISPLAYS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 241 days.

(21) Appl. No.: 09/956,030

(22) Filed: Sep. 20, 2001

(65) Prior Publication Data

US 2002/0047839 A1 Apr. 25, 2002

(30) Foreign Application Priority Data

Sep. 20, 2000 (JP) ..... 2000-285329
Aug. 24, 2001 (JP) ..... 2001-254850

(51) Int. Cl.[7] ..... G09G 3/30; G09G 5/00; G09G 3/10

(52) U.S. Cl. ..... 345/76; 345/211; 315/169.3

(58) Field of Search ..... 345/76–82, 204, 345/211; 315/169.3

(56) References Cited

U.S. PATENT DOCUMENTS

| | | | | |
|---|---|---|---|---|
| 5,844,368 A | | 12/1998 | Okuda et al. | |
| 5,959,599 A | | 9/1999 | Hirakata | |
| 6,091,203 A | * | 7/2000 | Kawashima et al. | 315/169.3 |
| 6,229,506 B1 | * | 5/2001 | Dawson et al. | 345/82 |
| 6,246,384 B1 | * | 6/2001 | Sano | 345/76 |
| 6,369,785 B1 | * | 4/2002 | Imai | 345/76 |
| 6,380,689 B1 | * | 4/2002 | Okuda | 315/169.3 |
| 6,535,185 B2 | * | 3/2003 | Kim et al. | 345/76 |

FOREIGN PATENT DOCUMENTS

| | | |
|---|---|---|
| EP | 0 878 789 A2 | 11/1998 |
| EP | 1 003 150 A1 | 5/2000 |
| JP | 04-308687 | 10/1992 |
| JP | 11-8064 | 1/1999 |
| JP | 11-272233 | 10/1999 |

OTHER PUBLICATIONS

Dawson, R. M. A. et al.: "The Impact of the Transient Response of ORganic Light Emitting Diodes on the Design of Active Matrix OLED Displays" ,IEDM 1998 Technical Digest, pp. 875–878, San Francisco, CA.

Langlois, E. et al.: "Degradation Mechanisms in Organic Light Emitting Diodes", Organic Photonic Materials and Devices II, vol. 39.39, pp. 158–163, 2000, USA.

Sato Yoshiharu, "Life–Extending Technology for Organic El Devices", Material development and suggestions for new material structures contribute to improved lifetime, Mitsubishi Chemicals.

* cited by examiner

*Primary Examiner*—Regina Liang
*Assistant Examiner*—Duc Q Dinh
(74) *Attorney, Agent, or Firm*—Oliff & Berridge, PLC

(57) ABSTRACT

The present invention provides an organic electroluminescence element driving circuit that is capable of realizing application of reverse bias without increasing power consumption and cost. The connected relationship between a power supply potential $V_{cc}$ and the GRD is changed by manipulating switches. With this arrangement, application of reverse bias to an organic electroluminescence element can be realized without newly preparing additional power supplies such as a negative power supply, and the like, whereby the life of an organic electroluminescence element can be increased.

18 Claims, 9 Drawing Sheets

SYSTEM AND METHODS FOR PROVIDING A DRIVING CIRCUIT FOR ACTIVE MATRIX TYPE DISPLAYS

BACKGROUND OF THE INVENTION

1. Field of Invention

The invention relates to a driving circuit for an active matrix type display using an electro-optical element, such as an organic electroluminescence element (hereinafter referred to as "organic electroluminescence element"), and the like. The invention further relates to a driving method of electronic device and an electronic apparatus, and to the electronic device. More particularly, the present invention relates to a driving circuit having a function for applying reverse bias to an electro-optical element to suppress the deterioration thereof, to a driving method of electronic device and an electronic apparatus, and to the electronic device.

2. Description of Related Art

It is known that a display can be realized by arranging a plurality of pixels in matrix that include an organic electroluminescence element that is one of electro-optical elements. In such a display, the organic electroluminescence element is arranged such that a laminated organic thin film including a light emitting layer is interposed between a cathode formed of a metal electrode, for example, Mg, Ag, Al, Li, and the like and an anode formed of a transparent electrode composed of ITO (indium tin oxide).

FIG. 8 shows an ordinary arrangement of a driving circuit for an active matrix type display using an organic electroluminescence element. In this figure, the organic electroluminescence element is shown as a diode 10. Further, the driving circuit 1 is composed of two transistors Tr1 and Tr2 each composed of a thin film transistor (TFT) and a capacitance element 2 for accumulating electric charge.

Herein both the transistors Tr1 and Tr2 are p-channel type TFTs. The transistor Tr1 can be controlled to be turned on and off according to the electric charge accumulated in the capacitance element 2 in the figure. The capacitance element 2 is charged by a data line $V_{DATA}$ through the transistor Tr2 that is turned on by setting a selection potential $V_{SEL}$ to a low level. When the transistor Tr1 is turned on, a current flows to the organic electroluminescence element 10 through the transistor Tr1. The continuous flow of the current to the organic electroluminescence element 10 permits the element to emit light continuously.

FIG. 9 shows a brief timing chart for the circuit of FIG. 8. As shown in FIG. 9, when data is to be written, the transistor Tr2 is turned on by setting the selection potential $V_{SEL}$ to the low level, whereby the capacitance element 2 is charged. This charge period is a writing period $T_W$ in the figure. An actual display period follows the writing period $T_W$. In this period, the transistor Tr1 is turned on by the electric charge accumulated in the capacitance element 2. This period is shown as a display period $T_H$ in the figure.

FIG. 10 shows another arrangement of the driving circuit for the organic electroluminescence element. The driving circuit shown in the figure is written in the literature "The Impact of Transient Response of Organic Light Organic Light Emitting Diodes on the Design of Active Matrix OLED Displays" (1998 IEEE IEDM 98-875). In FIG. 10, reference numeral Tr1 denotes a driving transistor, reference numeral Tr2 denotes a charge controlling transistor, reference numeral Tr3 denotes a first selection transistor, and reference numeral Tr4 denotes a second selection transistor that is turned off during the charge period of a capacitance element 2.

As is well known, the characteristics of transistors are dispersed even if they have the same standard. Accordingly, even if the same voltage is applied to the gates of transistors, a current having a given value does not always flow through the transistors, which may cause irregular luminance and the like. In contrast, in this driving circuit, electric charge is accumulated in the capacitance element 2 based on an amount of current according to a data signal output from a current source 4. Thus, the emitting state of organic electroluminescence can be controlled based on the amount of current according to data.

Herein all the transistors Tr1 to Tr4 are P-channel type MOS transistors. The transistors Tr2 and TR3 are turned on by setting a selection potential $V_{SEL}$ to a low level, which causes electric charge having a value according to the output from the current source 4 to be accumulated in the capacitance element 2. Then, after the selection potential $V_{SEL}$ goes to a high level and the transistors Tr2 and Tr3 are turned off, the transistor Tr1 is turned on by the electric charge accumulated in the capacitance element 2 and the transistor Tr4 is turned on by a data holding control signal $V_{gp}$ so that a current flows to the organic electroluminescence element 10.

FIG. 11 shows a brief timing chart as to the circuit of FIG. 10, As shown in FIG. 11, when data is to be written by the current source 4, the transistors Tr2 and Tr3 are turned on by setting the selection potential $V_{SEL}$ to the a low level, thereby charging the capacitance element 2. This charging period is a writing period $T_W$ in FIG. 11. An actual display period follows the write period $T_W$. During the period in which the data holding control signal $V_{gp}$ is set to the low level, the transistor Tr1 is turned on, and this turned-on period is a display period $T_H$.

FIG. 12 shows still another arrangement of the driving circuit for the organic electroluminescence element. The driving circuit shown in the figure is the circuit disclosed in Japanese Unexamined Patent Application Publication No. 11-272233. In this figure, the driving circuit includes a transistor Tr1 for supplying a current from a power supply to an organic electroluminescence element 10 when it is turned on, a capacitance element 2 for accumulating electric charge for maintaining the transistor Tr1 in the turned-on state, and a charge controlling transistor Tr5 for controlling the charge of the capacitance element 2 according to an external signal. Note that when the organic electroluminescence element 10 is to emit, a potential $V_{rscan}$ is maintained to a low level to turn off a charge controlling transistor Tr7. With this operation, no reset signal $V_{rsig}$ is output. Note that reference numeral Tr6 denotes an adjustment transistor.

The transistor Tr5 is turned on, and the capacitance element 2 is charged by a data line $V_{DATA}$ through a transistor Tr6. Then, the conductance between the source and the drain of the transistor Tr1 is controlled according the charged level of the capacitance element 2, and a current flows to the organic electroluminescence element 10. That is, as shown in FIG. 13, when a potential $V_{scan}$ is set to a high level to turn on the transistor Tr5, the capacitance element 2 is charged through the transistor Tr6. The conductance between the source and the drain of the transistor Tr1 is controlled according the charged level of the capacitance element 2, and a current flows to the organic electroluminescence element 10. The organic electroluminescence element 10 emits.

SUMMARY OF THE INVENTION

Incidentally, it is known that application of reverse bias to an organic electroluminescence element is an effective means to increase the life thereof. This increase of life is disclosed in, for example, Japanese Unexamined Patent Application Publication No. 11-8064.

However, in the method of the publication, additional power supplies such as a negative power source, and the like must be newly prepared to apply reverse bias to the organic electroluminescence element, and the organic electroluminescence element must be controlled so as to permit the reverse bias to be applied thereto.

Accordingly, an object of the present invention is to provide a driving circuit for an active matrix type display capable of applying reverse bias to an electro-optical element such as an organic electroluminescence element, and the like without almost increasing power consumption and cost, to provide a driving method of electronic device and an electronic apparatus, and to provide electronic device.

A first driving circuit for active matrix type display according to the present invention is a driving circuit that drives a display in which a plurality of pixels composed of an electro-optical element are disposed in matrix. The driving circuit includes a first terminal electrically connected to any one of a first power supply line for supplying a first potential and a second power supply line for supplying a second potential lower than the first potential, and a second terminal electrically connected to any one of the first and second power supply lines through the electro-optical element. Further, timing at least exists at which, when the electro-optical element is in a first operating state, the first terminal is electrically connected to the first power supply line and the second terminal is electrically connected to the second power supply line through the electro-optical element, and at which, when the electro-optical element is in a second operating state, the first terminal is electrically connected to the second power supply line and the second terminal is electrically connected to the first power supply line through the electro-optical element.

A second driving circuit for active matrix type display according to the present invention can further include a driving transistor for controlling an operating state of the electro-optical element, a capacitance element for accumulating electric charge for maintaining the driving transistor in a turned-on state, and a charge controlling transistor for controlling the charge to the capacitance element according to an external signal. Further, one of the electrodes constituting the capacitance element is electrically connected to the first terminal and the other electrode constituting the capacitance element is electrically connected to the gate electrode of the driving transistor, and the first terminal is electrically connected to the second terminal through the source and the drain of the driving transistor.

A third driving circuit for active matrix type display according to the present invention can further include a driving transistor for controlling an operating state of the electro-optical element, a capacitance element for accumulating electric charge for maintaining the driving transistor in a turned-on state, and a charge controlling transistor for controlling the charge to the capacitance element according to an external signal. Further, one of the electrodes constituting the capacitance element is electrically connected to the first terminal through a selection transistor that is turned off during the charge period of the capacitance element, the other electrode constituting the capacitance element is electrically connected to the gate electrode of the driving transistor, and the first terminal is electrically connected to the second terminal through the source and the drain of the driving transistor and through the source and the drain of the selection transistor.

A fourth driving circuit for active matrix type display according to the present invention can further include a driving transistor for controlling an operating state of the electro-optical element, a capacitance element for accumulating electric charge for maintaining the driving transistor in a turned-on state; and a charge controlling transistor for controlling the charge to the capacitance element according to an external signal. Further, one of the electrodes constituting the capacitance element is electrically connected to the gate electrode of the driving transistor, the other electrode constituting the capacitance element is electrically connected to the ground, and the first terminal is electrically connected to the second terminal through the source and the drain of the driving transistor.

In short, since a connected state of the first power supply and the second power supply to the driving circuit is changed by switches, reverse bias can be applied to an organic electroluminescence element without almost increasing power consumption and cost. In this case, a first power supply is ordinarily set to Vcc and a second power supply is ordinarily set to the ground (GND), and potentials which are originally prepared are used. However, when a difference of potential that is sufficient for the organic electroluminescence element to emit can be secured, the power supplies are not limited thereto.

In a fifth driving circuit for active matrix type display of the present invention, the electro-optical element can be an organic electroluminescence element.

A first electronic apparatus of the present invention can be an electric apparatus having an active matrix type display that includes the driving circuit.

A first method of driving electronic device of the present invention is a method of driving electronic device including a first power supply line having a first potential, a second power supply line having a second potential that is a potential lower than the first potential, and an electronic device electrically disposed between the first power supply line and the second power supply line. The method can include the steps of electrically connecting one end of the electronic element to the second power supply line when the other end of the electronic element is electrically connected to the first power supply line, and electrically connecting one end of the electronic element to the first power supply line when the other end of the electronic element is electrically connected to the second power supply line.

It should be noted that the terms "electrically disposed" are not always limited to the case that an electron element is directly connected to a power supply line and also includes the case that other element such as a transistor or the like is disposed between the power supply line and the electronic element. A liquid crystal element, an electrophoretic element, an electroluminescence element, and the like, for example, are exemplified as the electronic element. Further, the electronic element means a element that is driven when a voltage is applied or a current is supplied thereto.

In a second method of driving electronic equipment of the present invention, the electronic device can be a current-driven device that is driven by a current.

That is, when the electronic device is the current-driven element, a current flows in a forward direction or a reverse direction by the driving method.

A first electronic device of the present invention is an electronic device including a first power supply line having a first potential, a second power supply line having a second potential that is a potential lower than the first potential, and an electronic element electrically disposed between the first power supply line and the second power supply line. The device having one end of the electronic element electrically connected to the second power supply line when the other end of the electronic element is electrically connected to the first power supply line and one end of the electronic element electrically connected to the first power supply line when the other end of the electronic element is electrically connected to the second power supply line.

In second electronic device of the present invention, the electronic element can be disposed in a unit circuit that is disposed in correspondence to the node of a data line for supplying a data signal and a scan line for supplying a scan signal in the above electronic device.

In third electronic device of the present invention, the unit circuit can include a first transistor for controlling the conductivity of the electronic element, a second transistor the gate electrode of which is connected to the scan line, and a capacitance element connected to the gate electrode of the first transistor for accumulating electric charge corresponding to the data signal supplied from the data line.

BRIEF DESCRIPTION OF THE DRAWINGS

The invention will be described in detail with reference to the accompanying drawings, wherein like numerals reference like elements, and wherein.

DETAILED DESCRIPTION OF PREFERRED EMBODIMENTS

Figure 1:
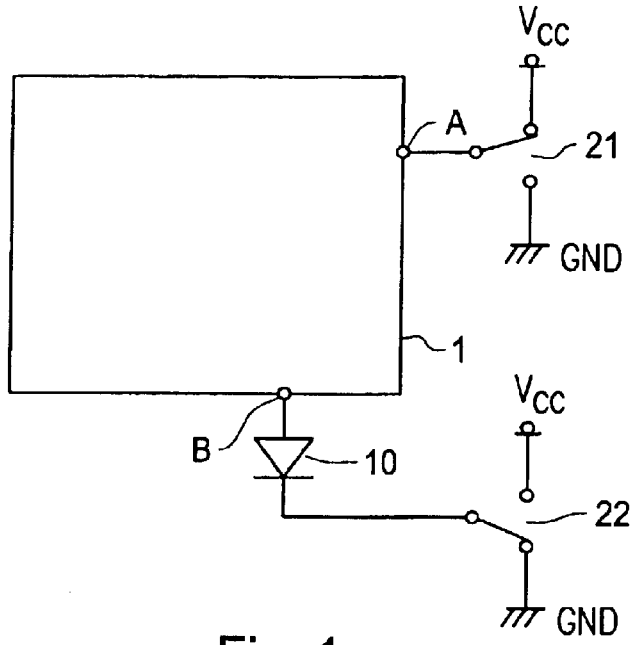
FIG. 1 is an exemplary block diagram showing an embodiment of a driving circuit for an organic electroluminescence element according to the present invention.

Next, an embodiment of the present invention will be described with reference to the drawings. Note that, in the respective drawings referred to in the following description, the same components as those in other drawings are denoted by the same reference numerals.

FIG. 1 is an exemplary block diagram showing a driving circuit for an active matrix type display using an organic electroluminescence element according to the present invention. As shown in the figure, the driving circuit 1 for the organic electroluminescence element of the embodiment has a first terminal A. The first terminal A can be electrically connected to any one of a first power supply line for supplying a first potential ($V_{cc}$) and a second power supply line for supplying a second potential GND lower than the first potential by a switch 21.

Further, the driving circuit 1 for the organic electroluminescence element can include a second terminal B. The second terminal B is electrically connected to a switch 22 through an organic electroluminescence element 10. The second terminal B can be electrically connected to any one of the first power supply line for supplying the first potential ($V_{cc}$) and the second power supply line for supplying the second potential GND lower than the first potential by a switch 22 through the organic electroluminescence element 10. Note that the first potential ($V_{cc}$) is a potential higher than the second potential (GND) and, for example, about 10 V.

When the organic electroluminescence element 10 emits (first operating state), that is, when display is performed, it is sufficient that the switch 21 be set to the first power supply line for supplying the first potential (Vcc) and that the switch 22 be set to the second power supply line for supplying the second potential (GND). At this time, the first terminal A is electrically connected to the first power supply line, and the second terminal B is electrically connected to the second power supply line through the organic electroluminescence element 10.

In contrast, when the organic electroluminescence device 10 does not emit (second operating state), that is, when no display is performed, it is sufficient that the switch 21 be set to the second power supply line for supplying the second potential (GND) and that the switch 22 be set to the first power supply line for supplying the first potential ($V_{cc}$). At this time, the first terminal A is electrically connected to the second power supply line, and the second terminal B is electrically connected to the first power supply line through the organic electroluminescence element 10. Since the potential of the second terminal B does not exceed the first potential ($V_{cc}$) in the above electrically-connected relationship, reverse bias is applied to the organic electroluminescence element 10. However, it is not necessary to continue the above electrically-connected relationship over the entire period during which the organic electroluminescence element 10 is in the second operating state. That is, it is sufficient to maintain the electrically-connected relationship in at least a part of the above period during which the organic electroluminescence element 10 is in the second operating state.

As described above, reverse bias can be applied to the organic electroluminescence element 10 only by changing the setting of the first and second switches 21 and 22. Since a power supply and GND which are prepared from the beginning are utilized in this case, it is not necessary to newly prepare additional power supplies such as a negative power supply and the like. Thus, power consumption is not increased as well as an increase in cost does not occur. Note that each of these switches 21 and 22 can be easily realized by the combination of transistors.

Figure 2:
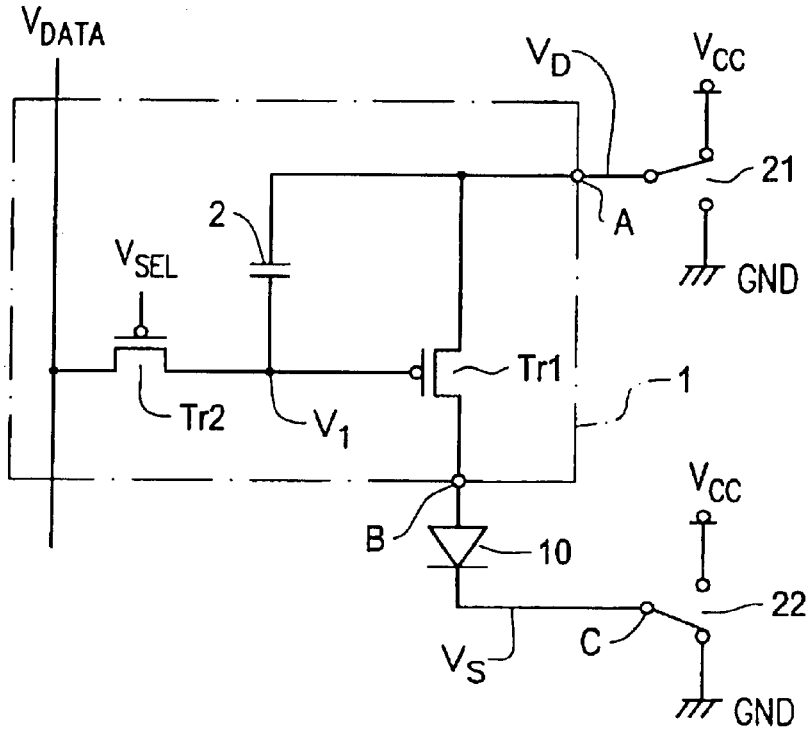
FIG. 2 is an exemplary block diagram showing a first example of the driving circuit for the organic electroluminescence element according to the present invention.
Figure 3:
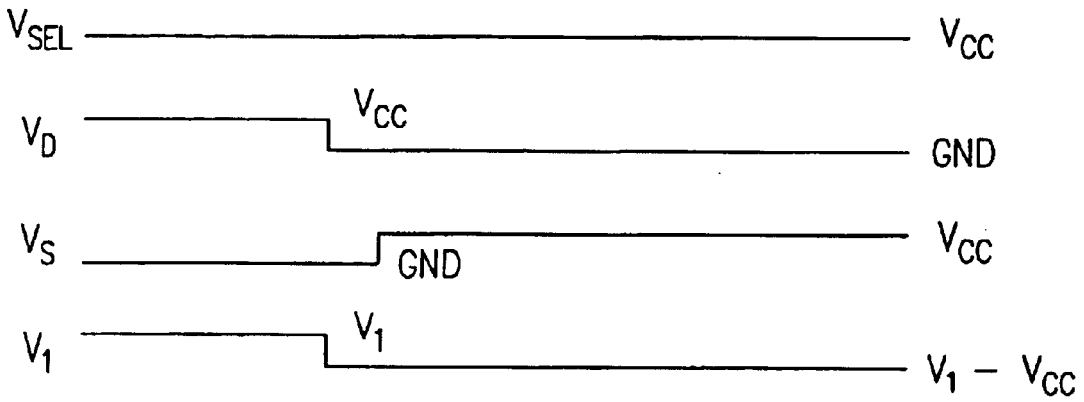
FIG. 3 is a waveform view showing the operation of the driving circuit for the organic electroluminescence element of FIG. 2.
Figure 8:
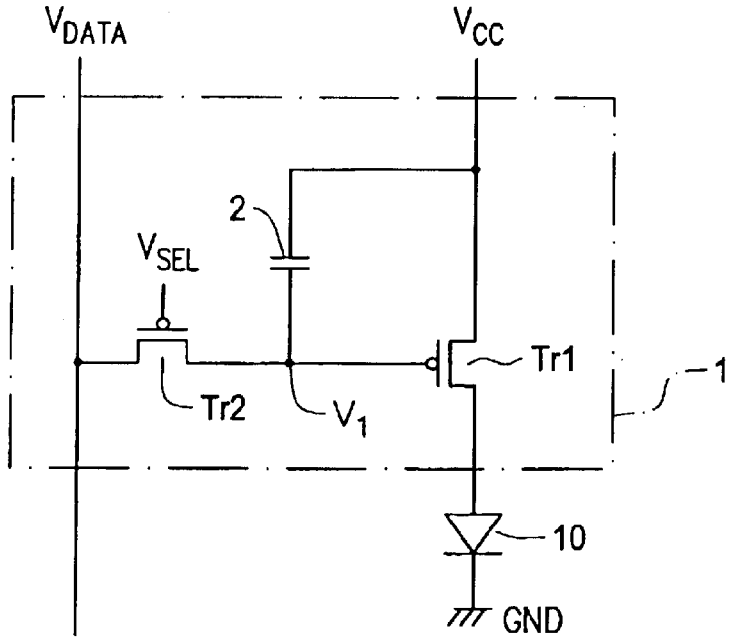
FIG. 8 is an exemplary block diagram showing an example of the arrangement of a driving circuit for a conventional organic electroluminescence element.
Figure 9:
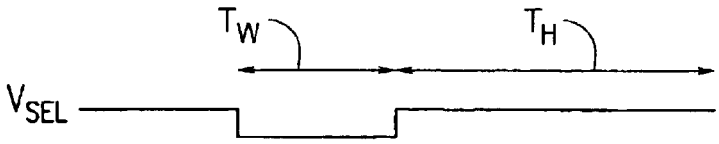
FIG. 9 is a waveform view showing the operation of the circuit of FIG. 8.

FIG. 2 is an exemplary block diagram showing the internal arrangement of a driving circuit according to a first example. In this figure, the circuit arrangement of FIG. 8 described above is employed in a driving circuit 1. That is, the driving circuit 1 includes a driving transistor Tr1 for controlling the operating state of an organic electroluminescence element 10, a capacitance element 2 for accumulating electric charge for maintaining the transistor Tr1 in a turned-on state, and a charging controlling transistor Tr2 for controlling the charge to the capacitance element 2 according to an external signal. In the driving circuit 1, one of the electrodes constituting the capacitance element 2 is electrically connected to a first terminal A, and the other electrode thereof constituting the capacitance element 2 is electrically connected to the gate electrode of the driving transistor Tr1. Further, one of the source and the drain constituting the driving transistor Tr1 is electrically connected to the first terminal A, and the other thereof constituting the driving transistor Tr1 is electrically connected to the second terminal B. As a result, the first terminal A is electrically connected to the second terminal B through the source and the drain of the driving transistor Tr1.

Then, an electrically connected state of the first terminal A and the second terminal B is changed by the switches 21 and 22. That is, when the organic electroluminescence element 10 emits (first operating state), the switch 21 is set to a power supply potential $V_{cc}$, and the switch 22 is set to the ground GND. It is sufficient in this state that the capacitance element 2 be charged, that the driving transistor Tr1 be turned on, and that a current flows to the organic electroluminescence element 10.

In contrast, when the organic electroluminescence element 10 does not emit (second operating state), it is sufficient that the switch 21 be set to the ground GND and that the switch 22 be set to the power supply potential $V_{cc}$. In this case, a selection potential $V_{SEL}$ is maintained to the power supply potential Vcc. The potential ($V_D$) of the first terminal A is dropped from the power supply potential $V_{cc}$ to the ground potential GND, and, after the drop thereof, the potential ($V_S$) of a third terminal C is risen from the ground potential GND to the power supply potential $V_{cc}$. Thus, the gate potential $V_1$ of the driving transistor Tr1 drops following the change of the potential $V_D$. Ordinarily, a wiring capacitance (not shown) is added to the gate line of the driving transistor Tr1. However, if the magnitude of the capacitance is negligible with respect to the capacitance of the capacitance element 2, the gate potential $V_1$ drops by the power supply potential $V_{cc}$ when the potential $V_D$ of the first terminal A changes from the power supply potential $V_{cc}$ to the ground potential GND. At this time, the potential of the second terminal B is equal to the threshold voltage ($V_{th}$) of the driving transistor Tr1 at the largest, whereby reverse bias is applied to the organic electroluminescence element 10 because the potential $V_S$ of the third terminal C is set to the power supply potential $V_{cc}$.

As described above, reverse bias can be applied to the organic electroluminescence element 10 only by changing the setting of the first and second switches 21 and 22. Since it is not necessary to newly prepare additional power supplies such as a negative power supply and the like, power consumption is not increased as well as a great increase in cost does not happen.

Figure 4:
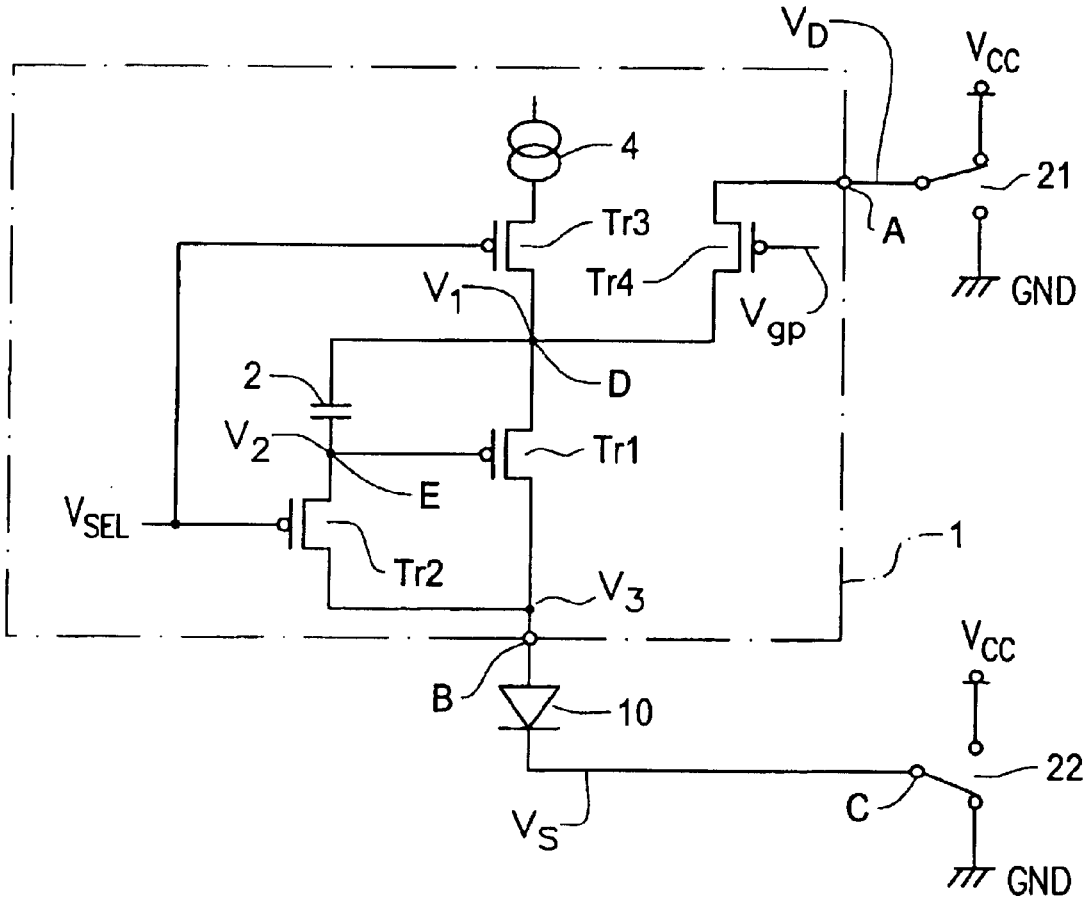
FIG. 4 is an exemplary block diagram showing a second example of the driving circuit for the organic electroluminescence element according to the present invention.
Figure 10:
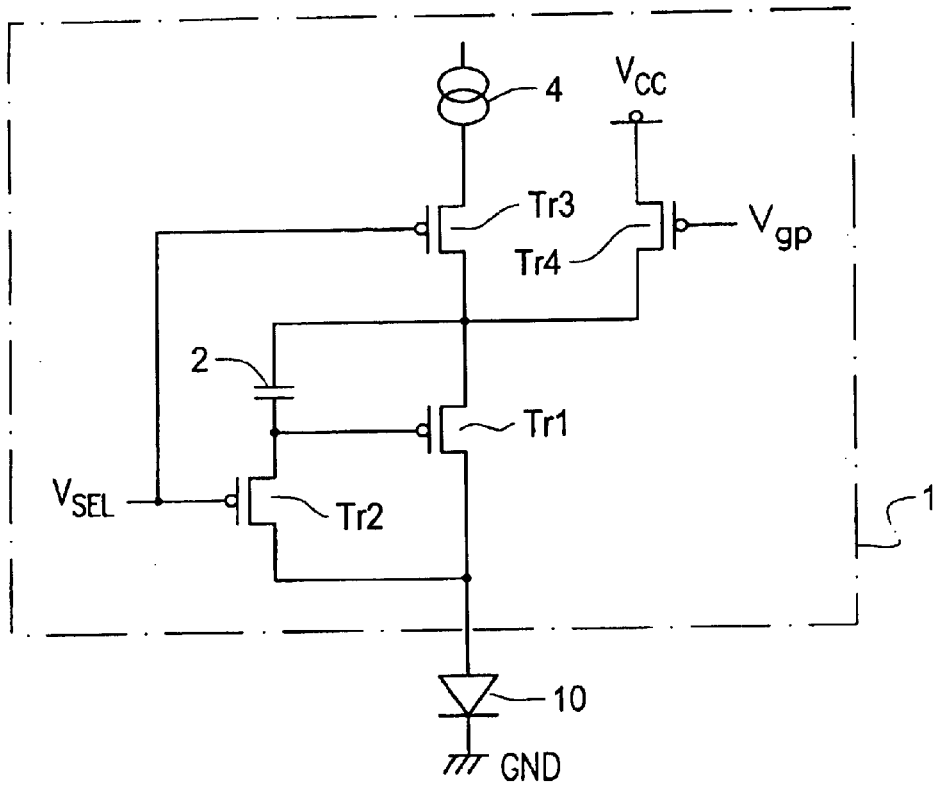
FIG. 10 is an exemplary block diagram showing another example of the arrangement of the driving circuit for the conventional organic electroluminescence element.
Figure 11:
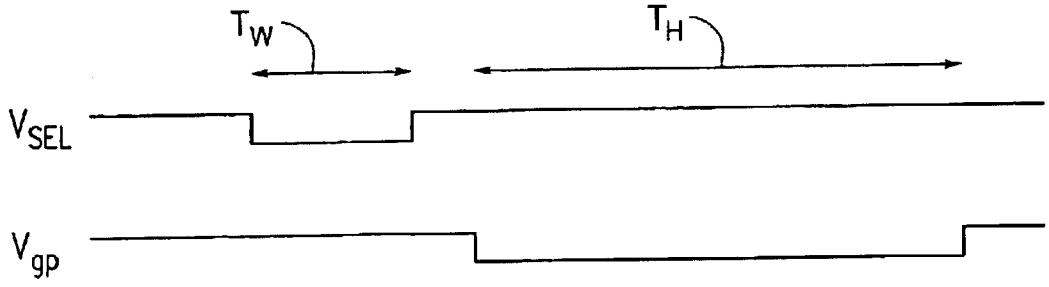
FIG. 11 is a waveform view showing the operation of the circuit of FIG. 10.
Figure 12:
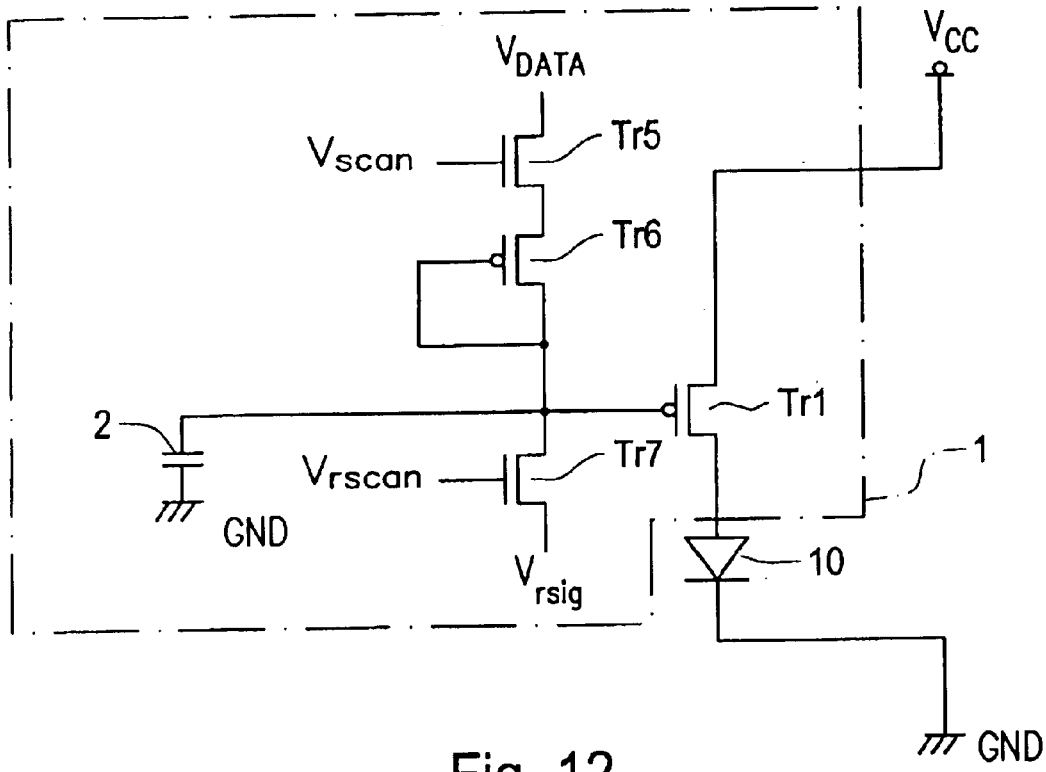
FIG. 12 is an exemplary block diagram showing another example of the arrangement of the driving circuit for the conventional organic electroluminescence element.
Figure 13:
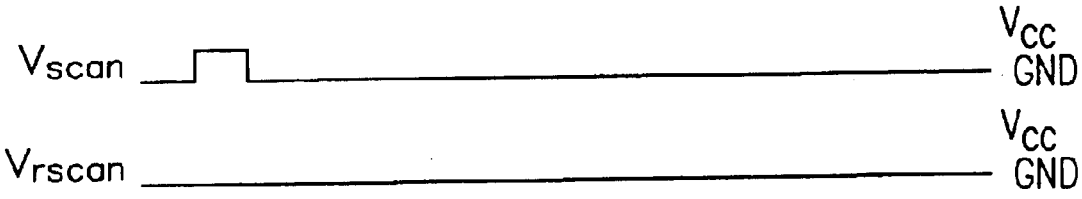
FIG. 13 is a waveform view showing the operation of the circuit of FIG. 12.

FIG. 4 is an exemplary block diagram showing the internal arrangement of a driving circuit according to a second example. In this figure, the circuit arrangement of FIG. 10 described above is employed in the driving circuit 1. That is, the driving circuit can include a driving transistor Tr1 for controlling the operating state of an organic electroluminescence element 10, a capacitance element 2 for accumulating electric charge for controlling the conductive state of the transistor Tr1, and a charge controlling transistor Tr2 for controlling the charge to the capacitance element 2 according to an external signal. In the driving circuit 1, one of the electrodes constituting the capacitance element 2 is electrically connected to a first terminal A through a second selection transistor Tr4, and the other electrode thereof constituting the capacitance element 2 is electrically connected to the gate electrode of the driving transistor Tr1. Further, one end of the driving transistor Tr1 is electrically connected to the first terminal A through the second selection transistor Tr4, and the other end thereof is electrically connected to the second terminal B. As a result, the first terminal A is electrically connected to the second terminal B through the sources and the drains of the driving transistor Tr1 and the selection transistor Tr4.

As is well known, the characteristics of transistors are dispersed even if they have the same standard. Accordingly, even if the same voltage is applied to the gates of transistors, a current having a given value does not always flow to the transistors, which may cause irregular luminance and the like. In contrast, in this driving circuit, electric charge is accumulated in the capacitance element 2 based on an amount of current according to a data signal output from a current source 4. Thus, the emitting state of organic electroluminescence can be controlled based on the amount of current according to data.

In this driving circuit, the electrically-connected relationship between the first terminal A and the second terminal B is changed to a power supply potential $V_{cc}$ and the ground potential GND by switches 21 and 22. That is, when the organic electroluminescence element 10 is to emit, it is sufficient that the switch 21 be set to the power supply potential $V_{cc}$, that the switch 22 be set to the ground potential GND, that the transistor Tr1 be turned on, that the transistor Tr4 be turned on, and that a current flows to the organic electroluminescence element 10.

Figure 5:
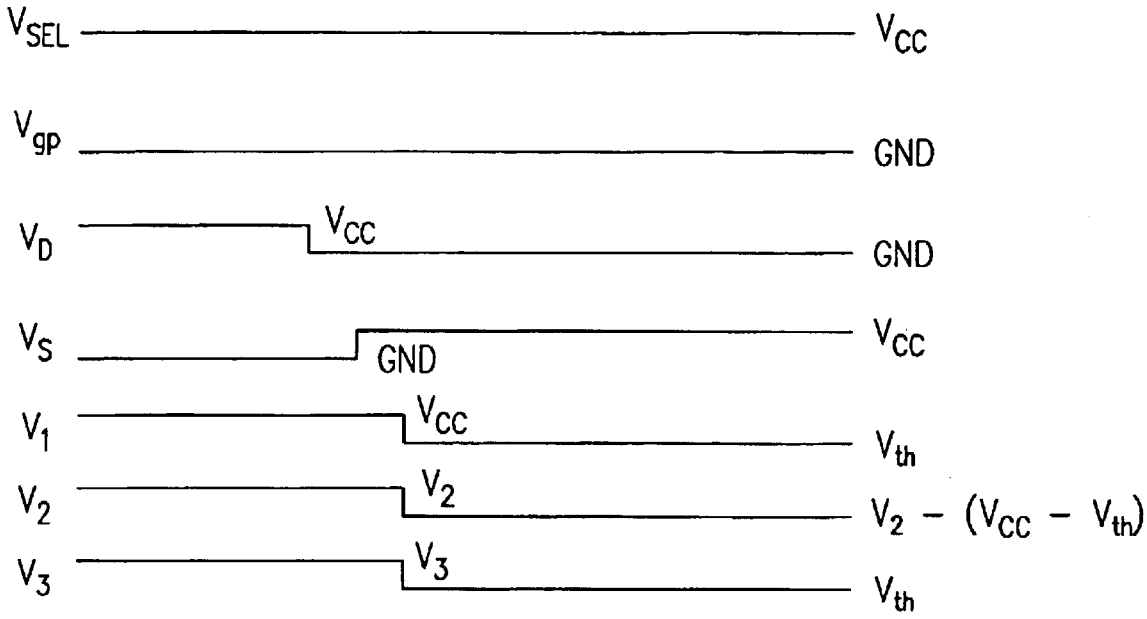
FIG. 5 is a waveform view showing the operation of the circuit of FIG. 4.

In contrast, when reverse bias is to be applied to the organic electroluminescence element 10, it is sufficient that the switch 21 be set to the ground potential GND and that the switch 22 is set to the power supply potential $V_{cc}$. In this case, as shown in FIG. 5, a selection potential $V_{SEL}$ is maintained to the power supply potential $V_{cc}$, and a data maintaining control signal $V_{gp}$ is maintained to the ground potential GND. Then, the potential $V_D$ of the first terminal A is dropped from the power supply potential $V_{cc}$ to the ground GND. After the drop of the potential $V_D$, the potential $V_S$ of the third terminal C is risen from the ground potential GND to the power supply potential $V_{cc}$. FIG. 5 shows only the operation after a current has been written in the driving circuit.

The potential $V_1$ of a node D drops from the power supply potential $V_{cc}$ to the threshold voltage $V_{th}$ of the transistor Tr4 following the drop of the potential $V_D$ of the first terminal A from the power supply potential $V_{cc}$ to the ground GND because the transistor Tr4 is turned on at all times. At this time, a wiring capacitance (not shown) is ordinarily added to the gate line of the transistor Tr1. However, if the magnitude of the capacitance is negligible with respect to the capacitance of the capacitance element 2, the potential $V_2$ of a node E changes to $V_2-(V_{cc}-V_{th})$. Further, when the potential $V_2$ is $V_2-(V_{cc}-V_{th})$, the potential $V_3$ of the second terminal B drops to the threshold voltage $V_{th}$. Note that the above description assumes that the threshold voltage of the transistor Tr1 is equal to that of the transistor Tr4. Reverse bias is applied to the organic electroluminescence element 10 as described above.

As described above, the application of reverse bias to the organic electroluminescence element 10 can be realized only by changing the setting of the switches. Since it is not necessary to newly prepare additional power supplies such as a negative power supply, and the like, power consumption is not increased as well as a great increase in cost does not occur.

Figure 6:
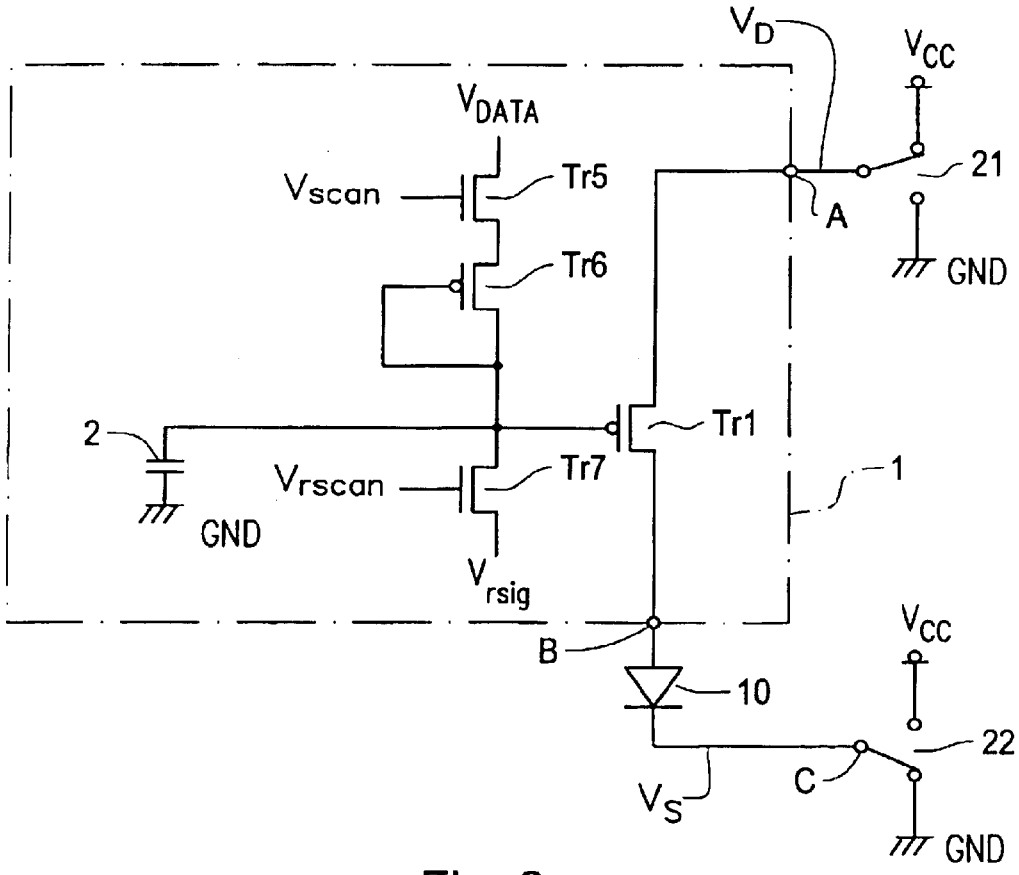
FIG. 6 is an exemplary block diagram showing a third example of the driving circuit for the organic electroluminescence element according to the present invention.

FIG. 6 is an exemplary block diagram showing the internal arrangement of a driving circuit according to a third example. In this figure, the circuit disclosed in Japanese Unexamined Patent Application Publication No. 11-272233 is employed in the driving circuit 1. That is, the driving circuit 1 can include a driving transistor Tr1 for controlling the operating state of an organic electroluminescence element 10, a capacitance element 2 for accumulating electric charge for maintaining the transistor Tr1 in a turned-on state, and a charge controlling transistor Tr5 for controlling the accumulated state of electric charge of the capacitance element 2 according to an external signal. In the driving circuit 1, one of the electrodes constituting the capacitance element 2 is electrically connected to the gate electrode of the transistor Tr1, and the other electrode thereof constituting the capacitance element 2 is electrically connected to the ground GND.

Further, one of the source and the drain constituting the driving transistor Tr1 is electrically connected to a first terminal A, and the other thereof constituting the driving transistor Tr1 is electrically connected to a second terminal B. As a result, the first terminal A is electrically connected to the second terminal B through the source and the drain of the driving transistor Tr1. Note that, in the figure, the transistor Tr1 and a transistor Tr6 are P-channel type transistors, and the transistor Tr5 and a transistor Tr7 are N-channel type transistors. Further, the transistor Tr6 connected to a diode has an effect for compensating the dispersion of the threshold value of the transistor Tr1.

In this driving circuit, the electrically-connected relationship between the first terminal A and the second terminal B is changed to a power supply potential $V_{cc}$ and to the ground potential GND by switches 21 and 22. That is, when an organic electroluminescence element 10 is to be emitted, the switch 21 is set to the power supply potential $V_{cc}$, and the switch 22 is set to the ground potential GND. In this state, the transistor Tr5 is turned on and the capacitance element 2 is charged through the transistor Tr6. Then, it is sufficient that the conductance between the source and the drain of the transistor Tr1 be controlled according the charged level and that a current flows to the organic electroluminescence element 10.

Figure 7:
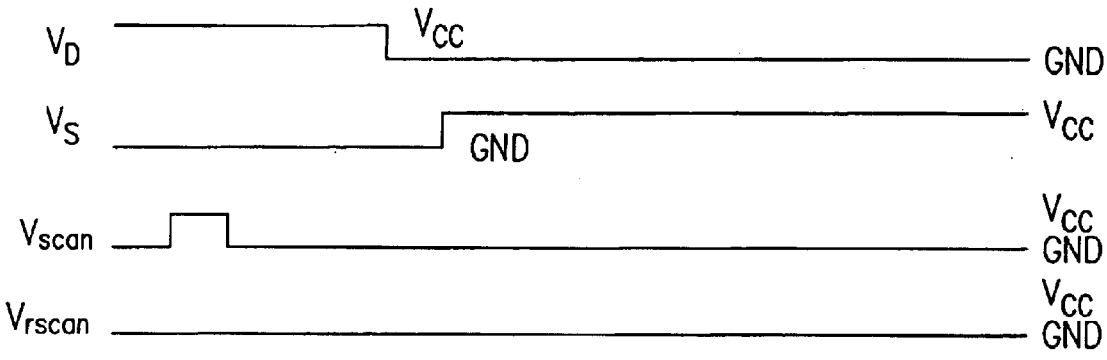
FIG. 7 is a waveform view showing the operation of the circuit of FIG. 6.

In contrast, when reverse bias is to be applied to the organic electroluminescence element 10, it is sufficient that the switch 21 be set to the ground potential GND and that the switch 22 be set to the power supply potential $V_{cc}$. In this case, first, the potential $V_{SCAN}$ that is to be applied to the gate electrode of the transistor Tr5 is set to the power supply potential $V_{cc}$, and then the capacitance element 2 is charged, as shown in FIG. 7. At this time, the potential $V_{SCAN}$ is set to the power supply potential $V_{cc}$ for a period during which the capacitance element 2 maintains (charges) electric charge which is sufficient to turn on the transistor Tr1. A data line $V_{DATA}$ must be set to a potential that permits the transistor Tr1 to be turned on.

After the capacitance element 2 has been charged, the switch 21 is manipulated to drop the potential $V_D$ of the first terminal A from the power supply potential $V_{cc}$ to the ground potential GND. Thereafter, the switch 22 is manipulated to rise the potential $V_S$ of a third terminal C from the ground potential GND to the power supply potential $V_{cc}$. Note that the transistor Tr7 is a reset transistor. When reverse bias is to be applied to the organic electroluminescence element 10, a potential $V_{RSCAN}$ is maintained to the ground potential GND to turn off the transistor Tr7.

As described above, reverse bias can be applied to the organic electroluminescence element 10 only by changing the setting of the switches. Since it is not necessary to newly prepare additional power supplies such as a negative power supply, and the like, power consumption is not increased as well as a great increase in cost does not happen.

It should be understood that while these two switches 21 and 22 are manipulated at shift timing in the above respective examples, it is apparent that they may be manipulated at the same time. When a change control signal is input to each of these switches at the shift timing, they can be manipulated at different timing. In this case, it is sufficient to input the respective control signals of the two switches through buffers each having a different number of stages.

While the driving circuits for the active matrix type display using the organic electroluminescence element have been described above, it should be understood that the scope of application of the present invention is not limited thereto, and the present invention also can be applied to an active matrix type display using electro-optical elements other than the organic electroluminescence element, for example, a TFT-LCD, a FED (field emission display), an electrophoresis element, a field inversion device, a laser diode, a LED, and the like.

Figure 14:
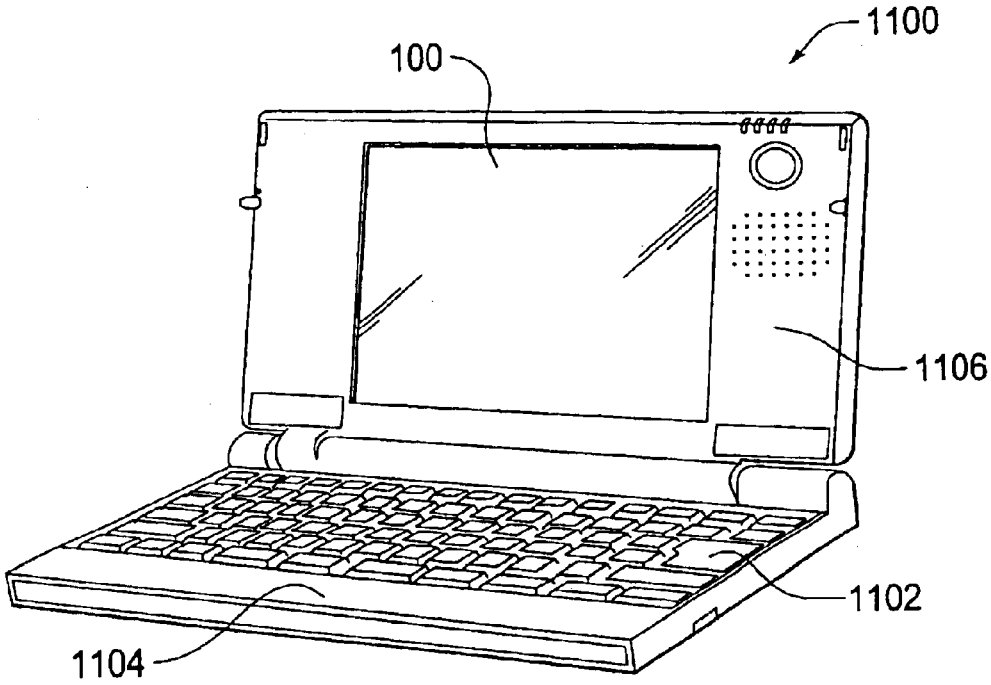
FIG. 14 is a view showing an example when an active matrix type display including the driving circuit according to an example of the present invention is applied to a mobile type personal computer.

Next, some examples of electronic apparatus to which the active matrix type display including a driving circuit 1 described above. FIG. 14 is a perspective view showing the arrangement of a mobile type personal computer to which this active matrix type display is applied. In this figure, the personal computer 1100 is composed of a main body 1104 having a key board 1102 and a display unit 1106 which includes the active matrix type display 100.

Figure 15:
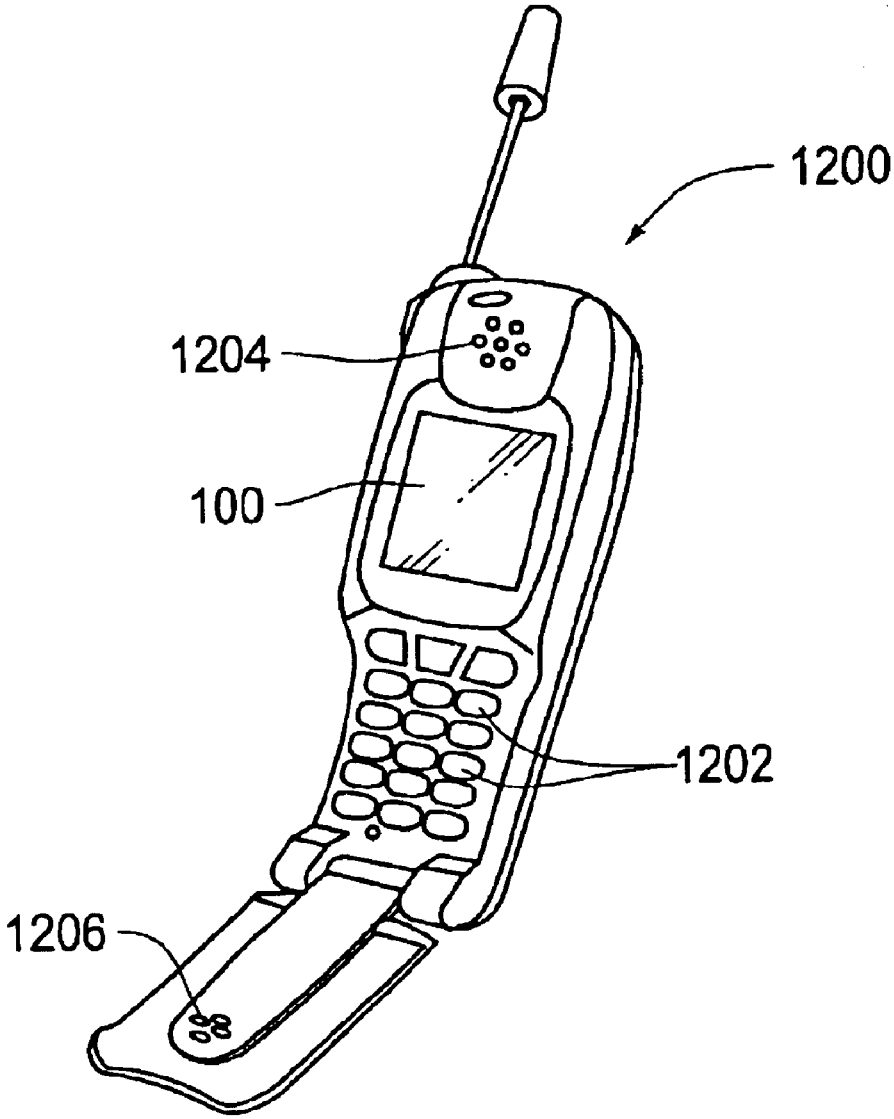
FIG. 15 is a view showing an example when an active matrix type display including the driving circuit according to an example of the present invention is applied to the display of a mobile phone.

Further, FIG. 15 is a perspective view showing the arrangement of a mobile phone having a display to which the active matrix type display 100 including the aforementioned driving circuit is applied.

In this figure, the mobile phone 1200 includes the aforementioned active matrix type display 100 together with a voice receiving port 1204 and a voice transmission port 1206, in addition to a plurality of manipulation buttons 1202.

Figure 16:
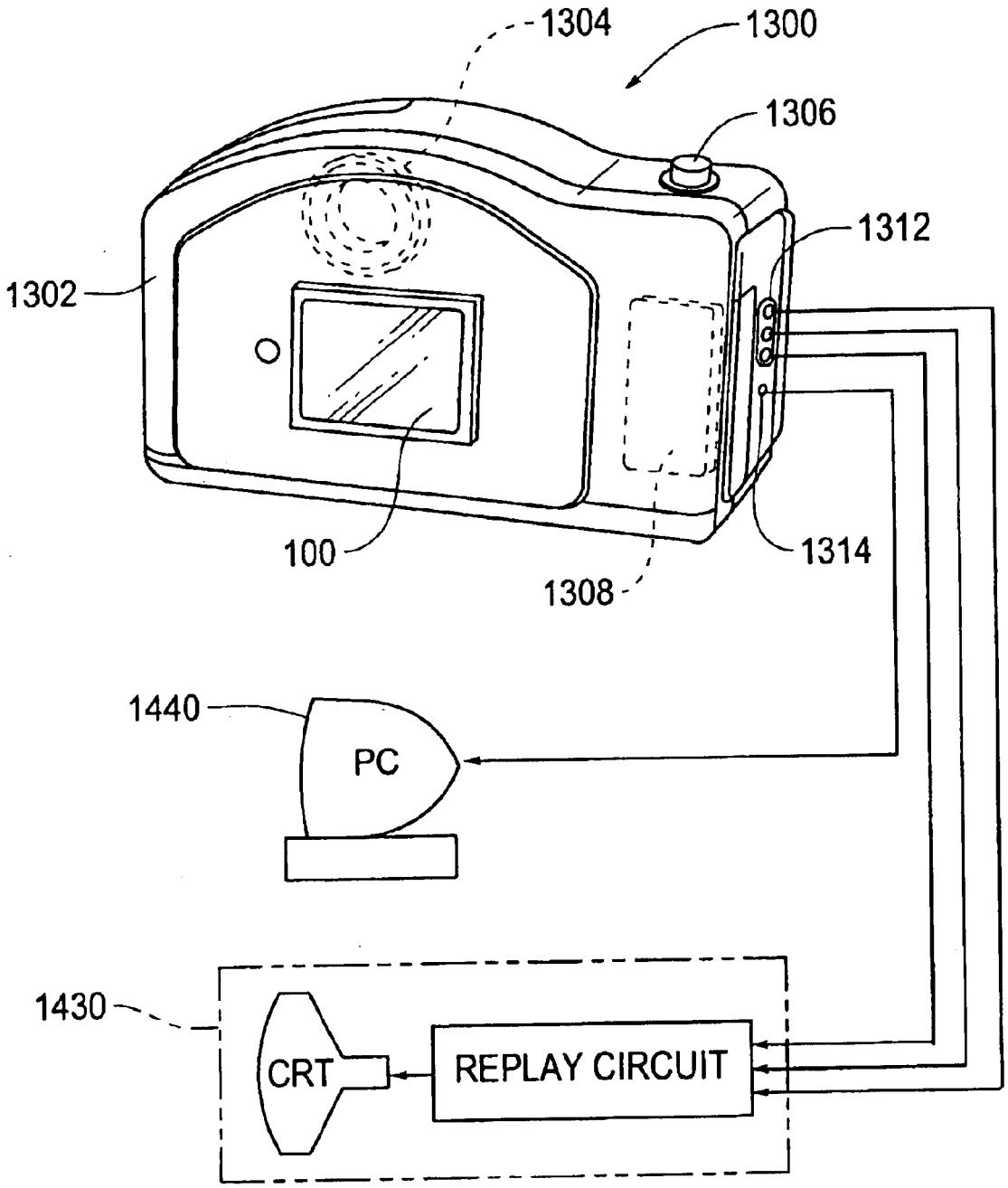
FIG. 16 is a perspective view showing a digital still camera when an active matrix type display including the driving circuit according to an example of the present invention is applied to a finder portion.

Further, FIG. 16 is a perspective view showing the arrangement of a digital still camera having a finder to which the active matrix type display 100 including the aforementioned driving circuit is applied. Note that this figure also simply shows connection to an external unit. The digital still camera 1300 creates an imaging signal by photoelectrically converting the light image of a subject by an imaging device such as a CCD (charge coupled device) or the like, while an ordinary camera exposes a film using the light image of the subject. The active matrix type display 100 is disposed on the back surface of the case 1302 of the digital still camera 1300 so as to make display based on the imaging signal created by the CCD, and the active matrix type display 100 acts as a finder for displaying the subject. Further, a light receiving unit 1304 including an optical lens, the CCD, and the like is disposed on the observing side (back surface side in the figure) of the case 1302.

When a photographer confirms the image of the subject displayed in the driving circuit and depresses a shutter button 1306, the imaging signal of the CCD at that time is transferred to and stored in the memory of a circuit substrate 1308. Further, in this digital still camera 1300, video signal output terminals 1312 and a data communication input/output terminal 1314 are disposed on a side of the case 1302. Then, as shown in the figure, a TV monitor 1430 is connected to the former video signal output terminals 1312 and a personal computer 1440 is connected to the latter data communication input/output terminal 1314, respectively when necessary. Further, the imaging signal stored in the memory of a circuit substrate 1308 is output to the TV monitor 1430 and the personal computer 1440.

It should be appreciated that the electronic apparatus to which the active matrix type display 100 of the present invention is applied can include a liquid crystal TV, view finder type and monitor-directly-observing type video tape recorders, a car navigator, a pager, an electronic note book, a pocket calculator, a word processor, a workstation, a TV phone, a POS terminal, equipment provide with a touch panel, and the like, in addition to the personal computer of FIG. 14, the mobile phone of FIG. 15, and the digital still camera of FIG. 16. In addition, the aforementioned active matrix type display 100 can be applied as the display of various other types of electronic equipment without departing from the spirit and scope of the present invention.

As described above, the present invention has an advantage that application of reverse bias can be realized by changing a connected state of a first power supply having a first potential and that of a second power supply having a second potential by switches without the need of newly preparing additional power supplies such as a negative power supply, and the like and without almost increasing power consumption and cost.

What is claimed is:

1. A driving circuit that drives an active matrix type display in which a plurality of pixels including an electro-optical element are disposed in a matrix, comprising:

a first terminal electrically connected to one of a first power supply line that supplies a first potential and a second power supply line that supplies a second potential lower than the first potential; and a second terminal electrically connected to one of the first and the second power supply lines through the electro-optical element, the first terminal and the second terminal being electrically connected to the first power supply line and second power supply line, respectively, through the electro-optical element when the electro-optical element is in a first operating state, and the first terminal and the second terminal being electrically connected to the second power supply line and the first power supply line, respectively, through the electro-optical element when the electro-optical element is in a second operating state.

2. The driving circuit for an active matrix type display according to claim 1, further comprising:

a driving transistor that controls an operating state of the electro-optical element;

a capacitance element that accumulates electric charge and maintains the driving transistor in a turned-on state; and a charge controlling transistor that controls the electric charge to the capacitance element according to an external signal, one of the electrodes of the capacitance element being electrically connected to the first terminal and another electrode of the capacitance element being electrically connected to a gate electrode of the driving transistor, and the first terminal being electrically connected to the second terminal through a source and a drain of the driving transistor.

3. The driving circuit for an active matrix type display according to claim 1, further comprising:

a driving transistor that controls an operating state of the electro-optical element;

a capacitance element that accumulates electric charge and maintains the driving transistor in a turned-on state; and a charge controlling transistor that controls the electric charge to the capacitance element according to an external signal, one of the electrodes of the capacitance element being electrically connected to the first terminal through a selection transistor that is turned off during the charge period of the capacitance element, another electrode of the capacitance element being electrically connected to a gate electrode of the driving transistor; and the first terminal being electrically connected to the second terminal through a source and a drain of the driving transistor and through a source and a drain of the selection transistor.

4. A driving circuit for an active matrix type display according to claim 1, further comprising:

a driving transistor that controls an operating state of the electro-optical element;

a capacitance element that accumulates electric charge and maintains the driving transistor in a turned-on state; and a charge controlling transistor that controls the electric charge to the capacitance element according to an external signal, one of the electrodes of the capacitance element being electrically connected to the gate electrode of the driving transistor;

another electrode of the capacitance element being electrically connected to the ground; and the first terminal being electrically connected to the second terminal through a source and a drain of the driving transistor.

5. The driving circuit for an active matrix type display according to claim 1, the electro-optical element being an organic electroluminescence element.

6. Electronic equipment having an active matrix type display that includes the driving circuit according to claim 1.

7. A method of driving an active matrix type display including a first power supply line having a first potential, a second power supply line having a second potential that is a potential lower than the first potential, and electro-optical element electrically disposed between the first power supply line and the second power supply line, the method comprising the steps of:

electrically connecting a first end of the electro-optical element to the second power supply line when a second end of the electro-optical element is electrically connected to the first power supply line when the electro-optical element is in a first operating state; and electrically connecting the first end of the electro-optical element to the first power supply line when the second end of the electro-optical element is electrically connected to the second power supply line when the electro-optical element is in a second operating state.

8. The method of driving active matrix type display according to claim 7, the electro-optical element being a current-driven element that is driven by a current.

9. An active matrix type display including a first power supply line having a first potential, a second power supply line having a second potential that is a potential lower than the first potential, and an electro-optical element electrically coupled between the first power supply line and the second power supply line, a first end of the electro-optical element being electrically connected to the second power supply line when a second end of the electro-optical element is electrically connected to the first power supply line when the electro-optical element is in a first operating state, and the first end of the electro-optical element being electrically connected to the first power supply line when the second end of the electro-optical element is electrically connected to the second power supply line when the electro-optical element is in a second operating state.

10. The active matrix type display device according to claim 9, the electro-optical element being disposed in a unit circuit that is disposed in correspondence to a node of a data line that supplies a data signal and a scan line for supplying a scan signal.

11. The active matrix type display device according to claim 10, the unit circuit comprising:

a first transistor that controls the conductivity of the electro-optical element;

a second transistor having a gate electrode that is connected to the scan line; and a capacitance element coupled to a gate electrode of the first transistor that accumulates electric charge corresponding to the data signal supplied from the data line.

12. The driving circuit for an active matrix type display according to claim 2, the electro-optical element being an organic electroluminescence element.

13. The driving circuit for an active matrix type display according to claim 3, the electro-optical element being an organic electroluminescence element.

14. The driving circuit for an active matrix type display according to claim 4, the electro-optical element being an organic electroluminescence element.

15. Electronic equipment having an active matrix type display that includes the driving circuit according to claim 2.

16. Electronic equipment having an active matrix type display that includes the driving circuit according to claim 3.

17. Electronic equipment having an active matrix type display that includes the driving circuit according to claim 4.

18. Electronic equipment having an active matrix type display that includes the driving circuit according to claim 5.

* * * * *